United States Patent [19]

Hollander

[11] 4,259,755

[45] Apr. 7, 1981

[54] ARTICLE OF FURNITURE AND MODULES FOR FORMING THE SAME

[76] Inventor: George Hollander, 340 W. 22nd St., New York, N.Y. 10011

[21] Appl. No.: 46,762

[22] Filed: Jun. 8, 1979

[51] Int. Cl.[3] ..... A47C 7/00; A47C 9/00

[52] U.S. Cl. ..... 5/58; 5/2 R; 5/308; 312/111

[58] Field of Search ..... 312/107, 108, 111, 198, 312/199, 257 R, 263, 330; 5/2 R, 58, 308

[56] References Cited

U.S. PATENT DOCUMENTS

| | | | |
|---|---|---|---|
| 3,031,125 | 4/1962 | Felton | 312/108 |
| 3,287,075 | 11/1966 | Batke | 312/111 |
| 3,746,416 | 7/1973 | Sasnett et al. | 312/111 |
| 3,841,727 | 10/1974 | Perig | 312/111 |
| 4,110,854 | 9/1978 | Sjolie | 5/58 |

*Primary Examiner*—Casmir A. Nunberg
*Attorney, Agent, or Firm*—Martin G. Raskin

[57] ABSTRACT

An article of furniture is formed of a plurality of interconnected modules. Each module comprises a cabinet module in that it is formed by exterior wall members which define an interior storage space therewithin. The module is constructed having one or more slidable drawers or a lid for providing access to the interior storage space. The modules are provided with connecting members, such as male and female fasteners on appropriate side wall members thereof for mutually interconnecting a plurality of such cabinet modules so as to form a desired article of furniture thereby inherently imbuing the article of furniture so formed with cabinet or storage capabilities. The modules can be interconnected in a multitude of different configurations to obtain a variety of different articles of furniture. In one embodiment, the modules are interconnected to form four rectilinearly extending module sub-assemblies to define the periphery of a mattress-receiving area, thus providing a bed having an inherently built-in cabinet or storage capability.

9 Claims, 16 Drawing Figures

FIG. 3
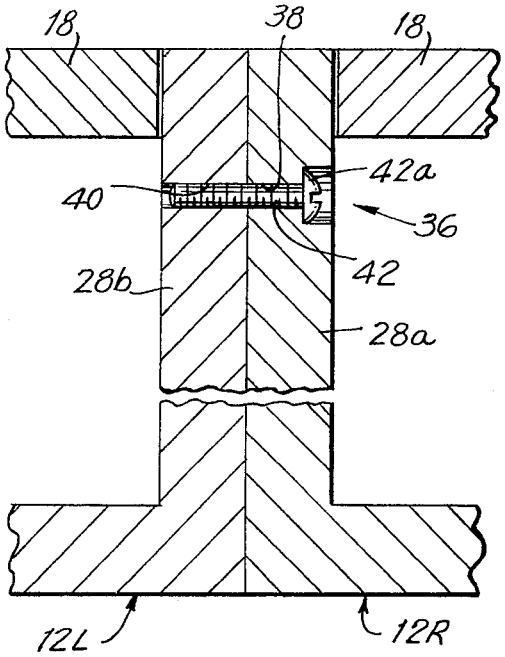
FIG. 4a
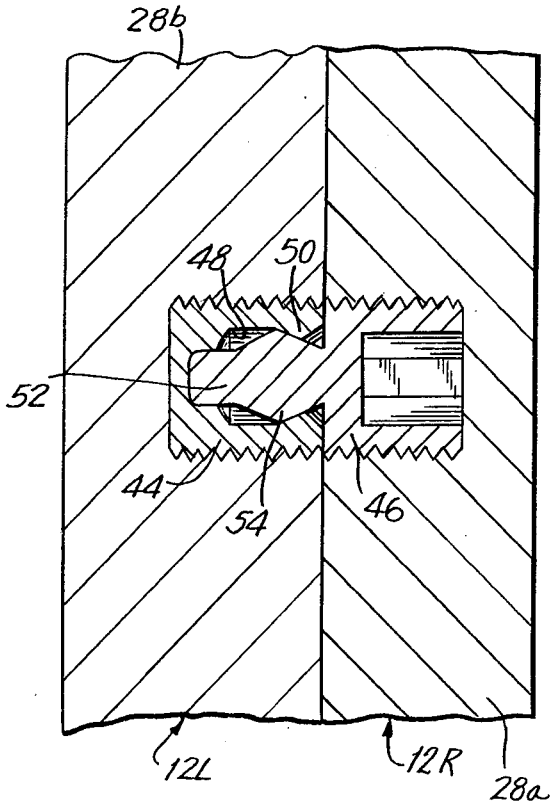
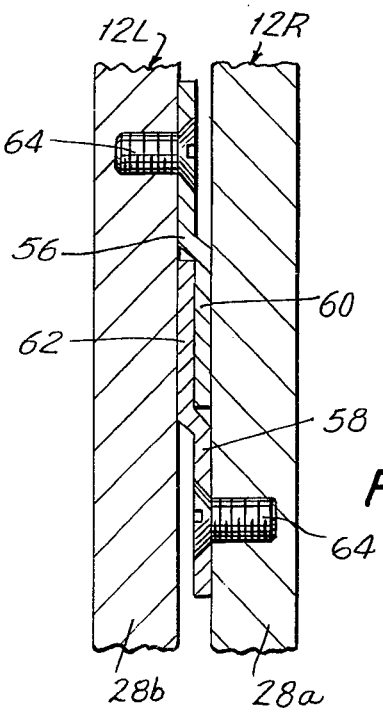
FIG. 4b

ARTICLE OF FURNITURE AND MODULES FOR FORMING THE SAME

BACKGROUND OF THE INVENTION

This invention relates generally to articles of furniture and, more particularly, to articles of furniture which are constructed utilizing a plurality of interconnected cabinet modules and to the modules for forming such articles of furniture.

Inhabitants of living areas which provide only a limited amount of usable space such, for example, as apartment dwellers, often find that an inadequate amount of space is available in a given room for various articles of furniture which are necessary are sufficient to meet their needs. Thus, for example, it is not uncommon for an apartment dweller having a bedroom of limited area to find an insufficient amount of space is available for both a bed having comfortable proportions and for cabinet space large enough in which to provide storage for various items, e.g., clothes, sleepwear, toiletries, etc. Under such circumstances, it has been necessary for such an inhabitant to compromise on the size or configuration of the articles of furniture or, in some cases, to do without such article of furniture completely.

Another problem frequently encountered in connection with home furnishings is that an expensive piece of furniture may be purchased having particular dimensions or configurations which render them particularly suitable for use at a certain location within the dwelling. Thus, for example, a person may purchase an expensive cabinet having particular length, height and/or depth dimensions to suit a particular wall or corner of a home. However, it frequently happens that such a person will relocate and find that this piece of furniture is either too large or too small for any appropriate area in his new dwelling. Of course, this is a disadvantage of conventional furniture which may become quite costly to the consumer.

Further, in recent years the cost to the consumer of aesthetically pleasing furniture has drastically increased. Although this fact is applicable equally to furniture of all periods, it is at least as true, if not more applicable, to so-called contemporary and modern furniture. Thus, the cost of such furniture in some cases has risen to the point where the purchase of a large article of furniture is beyond the reach of some if not most consumers.

SUMMARY OF THE INVENTION

Accordingly, one object of the present invention is to provide a new and improved article of furniture formed of interconnected cabinet-type modules and modules for constructing such furniture.

Another object of the present invention is to provide a new and improved article of furniture constructed utilizing cabinet modules so that the particular article of furniture so constructed is inherently provided with a storage capability sufficient to obviate the necessity for separate cabinets or the like.

Still another object of the present invention is to provide a new and improved article of furniture whose configuration and/or dimensions can be variously changed and modified so that the functional aspects of the article of furniture can be provided to suit any desired need.

Still yet another object of the present invention is to provide a new and improved article of furniture having all of the above advantages and, additionally, comprising a contemporary or modern design and whose cost is still reasonable.

Briefly, in accordance with the present invention, these and other objects are attained by providing an article of furniture which is formed from a plurality of interconnectable modules, the latter of which are appropriately constructed so as to provide a storage or cabinet space therewithin. More particularly, each such cabinet module is formed by exterior wall members which define an interior storage space. The modules are provided with appropriate apparatus for obtaining access to this interior storage space in the form of one or more slidable drawers and/or a hinged lid.

Each of the modules are provided on appropriate wall members with apparatus for interconnecting the cabinet modules to each other to form an interconnected module assembly. The location of such interconnecting apparatus is suitably varied on different modules so that practically any configuration of such a module assembly can be constructed to obtain any desired article of furniture.

It will be appreciated that any such article of furniture so constructed of the cabinet modules of the present invention will, itself, inherently have a storage capability to the desired extent, depending only on the choice of the consumer with respect to the particular type of cabinet module and their number. Thus, according to one embodiment of the invention, the cabinet modules of the present invention are constructed so as to provide the peripheral "frame" structure for a bed, i.e., so as to define the outer periphery of an interior rectangular mattress-receiving space. It is seen that such a bed constructed of the cabinet modules of the present invention will also provide sufficient storage space so that it is no longer necessary for the user to purchase a separate cabinet or chest.

Furthermore, an article of furniture constructed accordingto the present invention has the significant advantage that should it be so desired, such article of furniture can be completely disassembled and subsequently reassembled in a different manner so that a completely different article of furniture is obtained. This is especially advantageous in cases where it is necessary for a person to relocate on a fairly frequent basis due, for example, to work or other requirements.

Articles of furniture constructed according to the present invention have an extremely aesthetically pleasing appearance and yet the cabinet modules from which such articles of furniture are constructed are extremely simple in design thereby rendering the finished article of furniture relatively inexpensive.

DESCRIPTION OF THE DRAWINGS

A More complete appreciation of the invention and many of the attendant advantages thereof will be readily appreciated as the same becomes better understood by reference to the following detailed description when considered in connection with the accompanying drawings in which:

FIG. 3 is a section view taken along line 3—3 of FIG. 1 illustrating one type of interconnecting apparatus whereby adjacent cabinet modules can be interconnected to construct an article of furniture according to the present invention;

FIGS. 4*a* and *b* are view similar to FIG. 3 illustrating additional types of interconnecting apparatus which may be utilized in connection with the present invention;

DESCRIPTION OF THE PREFERRED EMBODIMENTS

Figure 1:
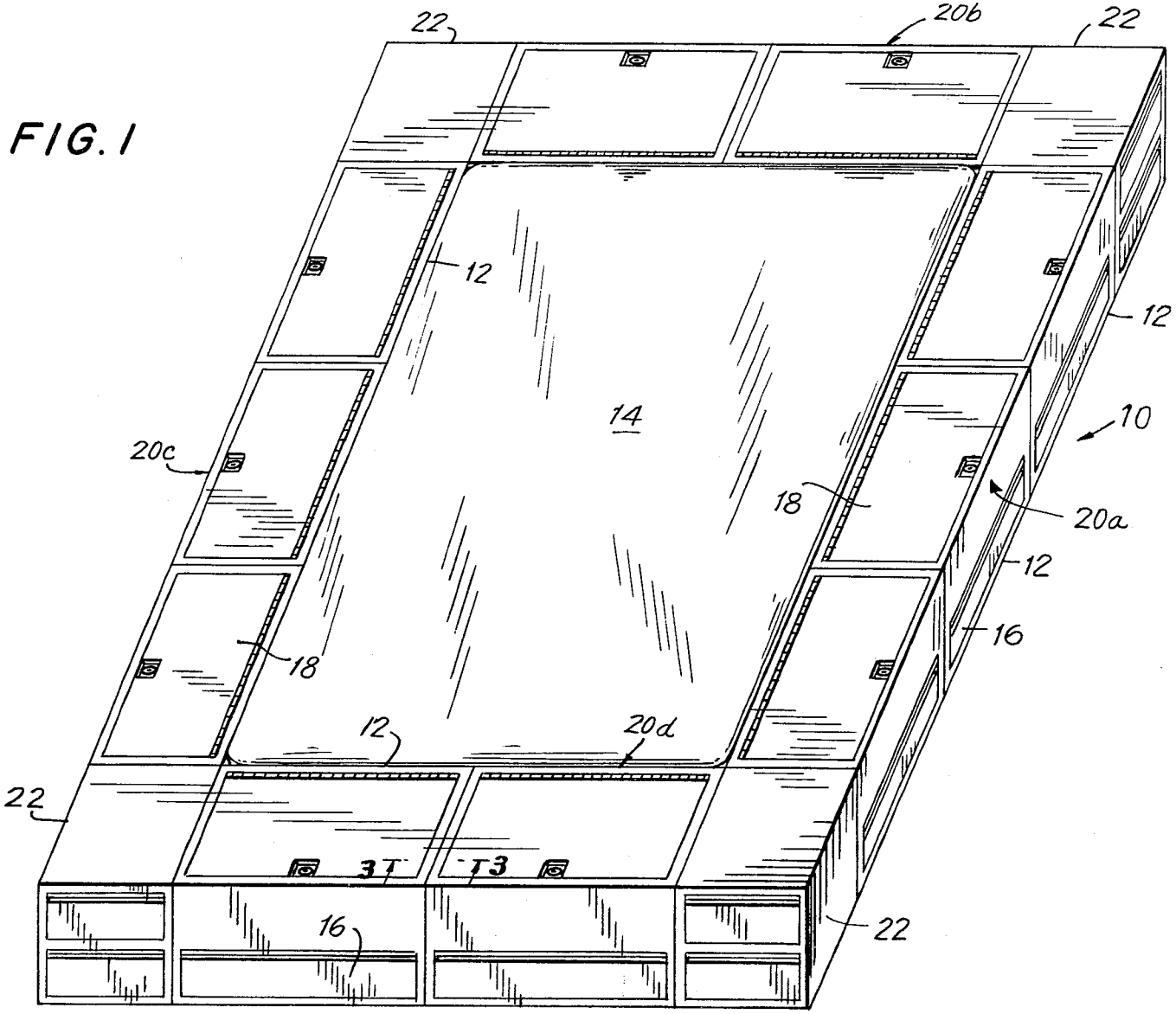
FIG. 1 is a perspective view of one embodiment of an article of furniture constructed in accordance with the present invention.

Referring now to the drawings wherein like reference characters designate identical or corresponding parts throughout the several views and, more particularly, to FIG. 1, an article of furniture, generally designated 10, constructed in accordance with the present invention is illustrated. The article of furniture 10 is formed of a plurality of interconnected cabinet modules 12 in a manner such that the module assembly formed thereby comprises the periphery of a rectangular interior space suitable for receiving a mattress 14. Thus, the article of furniture 10 is especially suited for use as a bed.

Each cabinet module 12, as explained in greater detail hereinbelow, is formed of a plurality of wall members which define an interior storage space within each module 12. Access to such interior space is provided in each module by means of slidable drawers 16 and/or hinged lids 18. In this manner, the article of furniture 10 comprising a bed is inherently provided with an uncommonly large area for storage purposes.

Each cabinet module 12 is interconnected to its adjacent cabinet modules by suitable apparatus for interconnecting the same, also described in detail hereinbelow. The cabinet modules 12 are located with their side wall members in contiguous relation so that in this manner and in connection with the embodiment of the invention illustrated in FIG. 1, four rectilinearly extending module sub-assemblies 20*a*–20*d* are formed, each module sub-assembly defining one side of a "frame" defining the mattress-receiving area. The four module sub-assemblies 20 are interconnected at their four corners by corner modules 22 which may differ in dimension from the cabinet modules 12 but which may also provide interior storage space therewithin in accordance with the present invention.

Although the bed illustrated in FIG. 1 is defined by a pair of longer longitudinally extending module sub-assemblies 20*a,c* and a pair of shorter transverse module sub-assemblies 20*b, d,* the former being defined by three cabinet modules 12 while the latter are each formed by a pair of cabinet modules 12, it is to be understood that a bed constructed in accordance with the present invention may have module assemblies formed of more or less cabinet modules, as desired. Further, other configurations for beds may be utilized. Thus, rather than utilizing four module sub-assemblies to define an interior mattress-receiving space as shown in FIG. 1, one wall of a room may be substituted for one of the module sub-assemblies so that only three such module sub-assemblies are required. Similarly, a corner of a room may be utilized in lieu of the appropriate longitudinal and transverse module sub-assemblies, e.g., 20*a, b.*

It is also to be understood that the dimensions of a cabinet module may be suitably chosen as desired although it may be preferable to provide standard sized modules for convenience both in marketing and in use.

Figure 2C:
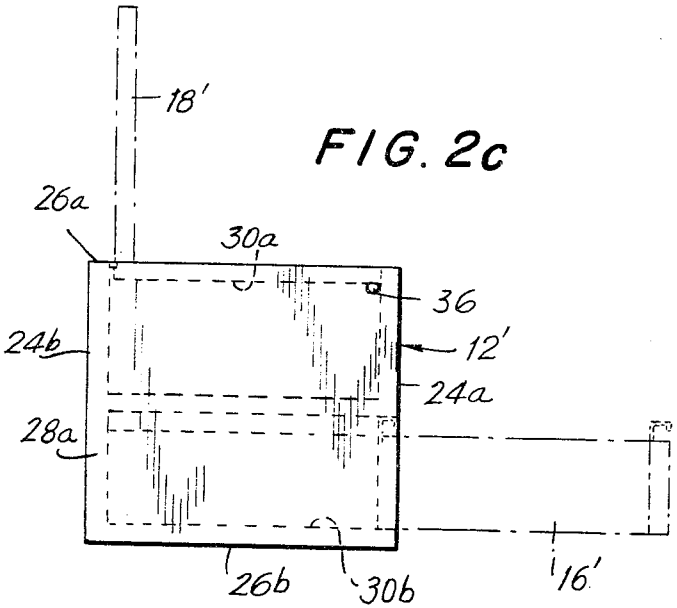
FIGS. 2*a*–2*c* are plan, front and side views of one embodiment of a cabinet module according to the present invention.
Figure 2A:
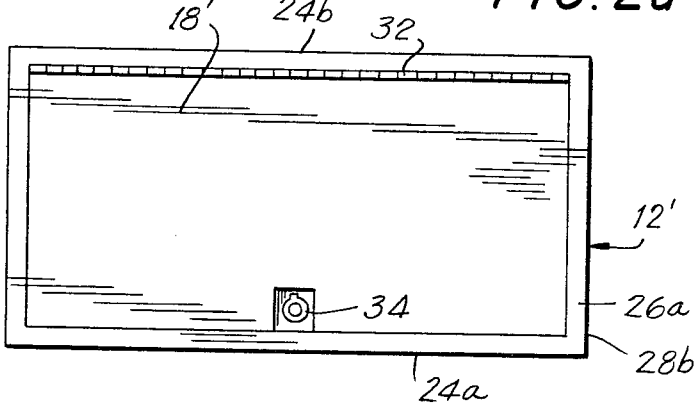
Figure 2B:
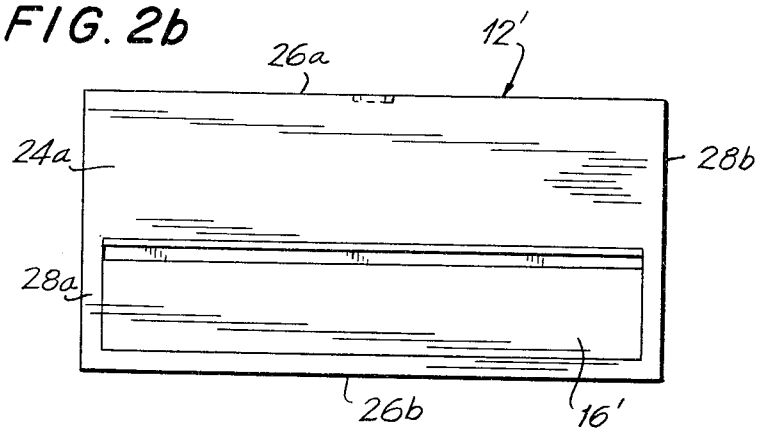

Referring to FIGS. 2*a*–2*c,* one embodiment of a cabinet module 12' is illustrated. Each such module 12' has a box-shaped configuration and is defined by front and rear wall members 24*a, b,* top and bottom wall members 26*a, b* and left and right side wall members 28*a,b,* respectively. A typical standard size for a cabinet module 12' is 16 inches high, 30 ½ inches long and 15 inches deep. Of course, it is understood that these dimensions may suitably vary, e.g., the length dimensions may be changed to 27 or even 16 inches. In the embodiment of the article of furniture 10 illustrated in FIG. 1, it was found desirable to utilize cabinet modules 12 forming the longitudinal module sub-assemblies 20*a,* 20*c* of modules 12 having dimensions 16×30 ½×15, the transverse module sub-assemblies 20*b,* 20*d,* of cabinet modules having dimensions of 16×27 ×15 and, providing corner modules 22 having dimensions of 16×16×15.

The wall members of each module may be constructed of any suitable material such, for example, as hardwood, plywood, or composition board. Further, the surface of the wall members may be appropriately finished by the application of a laminated surface, carpet, veneer, lacquer, stainless steel, etc.

As seen in FIG. 2, the illustrated embodiment of the cabinet module 12' defines upper and lower interior storage spaces 30*a, b,* respectively. Access to the upper storage space 30*a* is obtained by means of a lid 18' hinged within an opening provided in the top wall member 26*a* by means of a piano hinge 32 and which is provided with a latch 34 while access to the lower storage space 30*b* is provided by a sliding drawer 16'. The drawer and lid 16', 18' are provided in a manner such that their forward and upper surfaces, respectively, are flush with the front and top wall members 24*a,* 26*a* when in their closed position.

Thus, the cabinet module 12' illustrated in FIG. 2 is particularly suited for use in connection with the bed structure illustrated in FIG. 1 in that the top wall members of each of the cabinet modules utilized therein are readily accessible so that the lids may be easily opened.

As mentioned above, according to an important feature of the present invention, each of the cabinet modules are provided with apparatus for interconnecting the same to adjoining cabinet modules to form a module assembly. Any one of a variety of connecting apparatus which are conventional per se may be utilized in connection with the present invention. However, it is desirable that such interconnecting apparatus be of the type such that once connected, interconnected cabinet modules may be easily disconnected so as to facilitate redesign or transport of the article of furniture. Referring to FIG. 2C, apparatus for interconnecting the cabinet modules is schematically illustrated at 36. Thus, such interconnecting apparatus 36 is provided in the upper, forward corner region of the left side wall member 28*a* of cabinet module 12'. It is understood that interconnecting apparatus corresponding to apparatus 36 is provided in a corresponding position in the right side wall member 28*b* (not shown) in a manner such that a pair of cabinet modules 12', when located with their respective right side wall members in contiguous relationship with each other, the respective interconnecting apparatus provided in the left and right side wall members will align so as to permit the interconnecting apparatus to be operatively associated with each other as described below.

Referring to FIG. 3, a preferred embodiment of the interconnection apparatus 36 is illustrated. A pair of cabinet modules 12L and 12R are located so that their right and left side wall members 28*b*, 28*a*, respectively are in mutual contiguous relationship. A countersunk bore 38 is formed through the left side wall member 28*a* of the right cabinet modules 12R, preferably in the connection area illustrated in FIG. 2C. Of course, it is understood that the interconnecting apparatus 36 may be provided at any convenient location through the respective side wall members of the cabinet modules. It has been found, however, that the location of such apparatus as shown in FIG. 2C facilitates the connecting operation in that the location is readily accessible upon opening the lid 18. A threaded bore 40 is formed at an analogous location through the right side wall member 28*b* in a manner such that when the left and right cabinet modules 12L and 12R are located as shown in FIG. 3, the bores 38, 40 will become aligned. A threaded fastener member 42 is then passed through bore 38 and threadedly engages the bore 40, the fastener member 42 being rotated until its head portion 42*a* abuts the shoulder formed in the countersunk portion of bore 38.

Thus, FIG. 3 illustrates one embodiment of interconnecting apparatus which may be utilized in connection with the present invention and which comprises a male connector element (threaded fastener member 42) and a female connector element (threaded bore 40).

Referring now to FIG. 4*a*, another type of apparatus for interconnecting the cabinet modules is illustrated and, like the embodiment illustrated in FIG. 3, comprises a male-female connecting arrangement. More particularly, the interconnecting apparatus illustrated in FIG. 4*a* comprises a snap type fastening arrangement and includes a female insert member 44 which is threaded into the right side wall member 28*b* of a cabinet module and a male insert member 46 threadedly provided in the left side wall member 28*a* of an adjacent cabinet module. Female insert member 44 has a cavity 48 formed therein which opens onto the exterior surface of right side wall member 28*b*, the cavity 48 having a reduced diameter throat portion 50. The male insert member 46 includes an outwardly extending projection 52 having an enlarged diameter mid-portion 54. Insert members 44, 46 are constructed of a resilient material, such as plastic, so that when cabinet modules 12L and 12R are brought into contiguous relationship, projection 52 is received within cavity 48. The mid-portions 54 of projection 52 will be formed as the same passes beyond throat portion 50 of cavity 48 so as to effect a snap engagement therewith. As mentioned above, such snap type fasteners are conventional per se. However, such fasteners are advantageous for use in connection with the present invention in that the connection of cabinet modules does not require access to the interior storage area within each module. In other words, it is only required that the respective connection areas of each module be aligned with each other and the modules moved into contiguous relationship in a manner such that the projection 52 is guided into recess 48.

Yet another manner of connecting cabinet modules according to the present invention is illustrated in FIG. 4*b*. In this embodiment, a pair of flange members 56, 58 are provided on the right and left side wall members 28*b*, 28*a*, respectively, of adjacent cabinet modules 12L and 12R. Flange members 56, 58 are each formed with raised tongues 60, 62 which mutually interlock upon appropriately locating the cabinet modules 12L, R in contiguous relationship. The flange members are attached to their respective side wall members by conventional means, such as by screws 64. As in the case of the snap type male-female connector arrangement illustrated in FIG. 4*a*, access to the interior of the cabinet modules is not required when utilizing the interlocking flange construction illustrated in FIG. 4*b*.

It is readily seen from the above that any appropriate type of interconnecting apparatus may be utilized in connection with the present invention. For example, other types of male-female connector arrangements may be used than those illustrated in FIGS. 3 and 4*a*. For example, it is possible to provide a pair of aligned, smooth bores in the respective right and left side wall members of left and right cabinet modules, which bores align with each other upon appropriate location of the cabinet modules. An elongated threaded fastener may be passed through the aligned bores so that its enlarged head bears against the inner surface of one of the side wall members while its other end extends through the bore formed in the other side wall member. A nut is provided on the other end of the elongated threaded fastener to fasten the cabinet modules to each other.

Figure 7A:
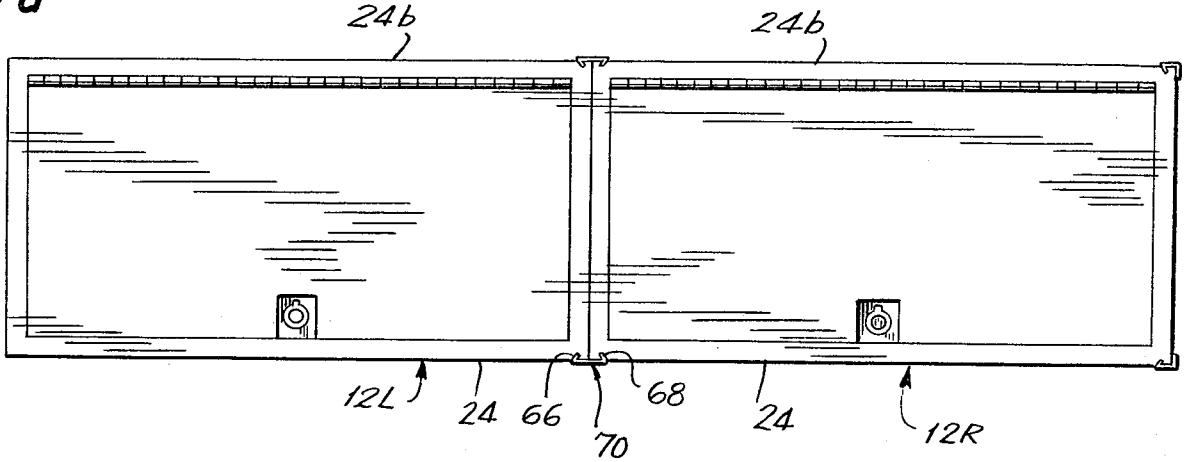
FIGS. 7*a* and 7*b* are plan and front views of a pair of cabinet modules according to the present invention in their interconnected configuration, the apparatus for interconnecting the same being illustrated in FIG. 7*c.
Figure 7B:
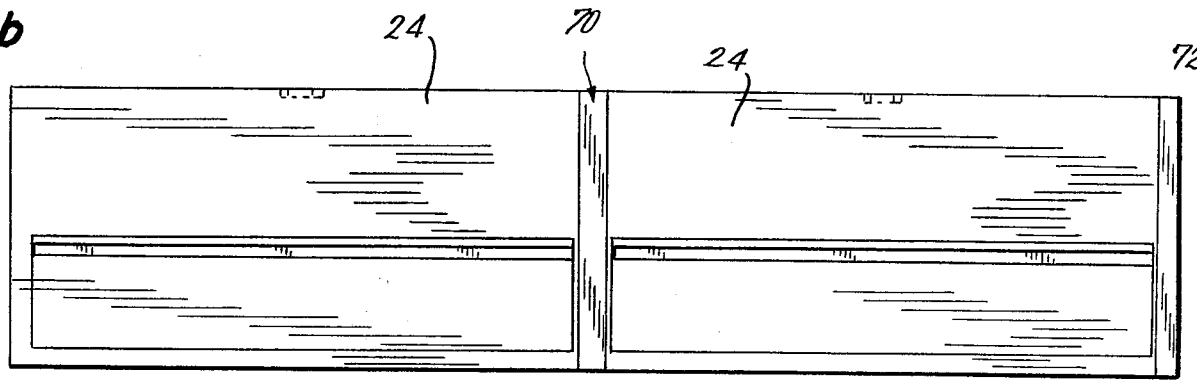
Figure 7C:
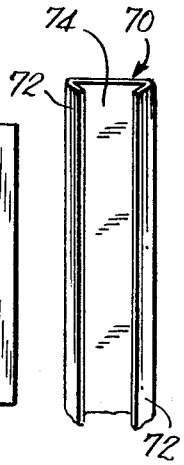

Referring to FIGS. 7*a*–7*c*, yet another embodiment of apparatus for interconnecting the cabinet modules is illustrated. In this embodiment, shallow slots 66, 68 vertically extend along the right and left edge regions of the front wall 24 of the modules 12L and 12R. A clamping element 70 comprises a pair of inwardly directed flange portions 72 connected by a web portion 74. Upon locating the left and right cabinet modules 12L and 12R in contiguous relationship as seen in FIGS. 7*a* and 7*b*, the flange portion 72 of clamping element 70 are inserted into the slots 66, 68 which are located in parallel, adjacent relationship to effect a connection of the modules to each other. The connecting element 70 may be constructed of an aesthetically pleasing material, such for example as extruded aluminum to give the cabinet assembly constructed thereby a pleasing appearance. As seen in FIG. 7*a*, if desired, an identical clamping element may be provided on the rear wall members 24*b* of the cabinet modules. This is desirable where a more rigid connection is required than can be obtained using only a single clamping element 70.

Figure 5B:
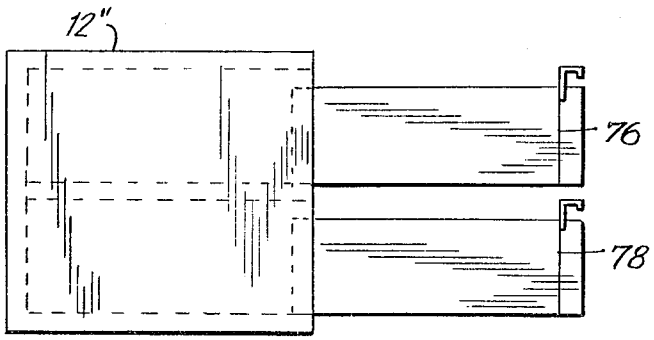
FIGS. 5*a* and 5*b* are front and side views of another embodiment of a cabinet module according to the present invention; the drawers of the cabinet module being shown in their open position in FIG. 5*b;*
Figure 6B:
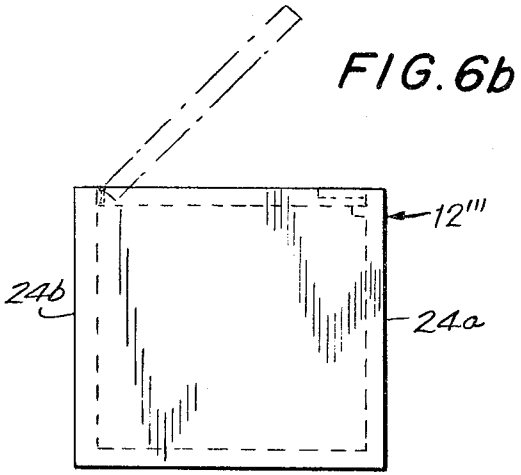
FIGS. 6*a* and 6*b* are plan and side views of still another embodiment of a cabinet module constructed in accordance with the present invention, the lid of the module being shown in its open position in FIG. 6*b;*

As mentioned above, the cabinet modules according to the present invention may take any convenient form which provides an interior storage space and access thereto. Thus, referring to FIGS. 5*a* and *b*, another embodiment of a cabinet module according to the present invention is illustrated. More particularly, cabinet module 12'' has essentially the same construction as cabinet module 12' illustrated in FIG. 2 except that the former is provided with upper and lower drawers 76, 78, respectively which slide outwardly from the front wall member 24*a* as best seen in FIG. 5*b*. Cabinet module 12″ is particularly suited for use in connection with articles of furniture wherein it is desired to place objects (or other modules) on top of cabinet module 12″. Thus, where a plurality of cabinet modules are interconnected to form a wall unit, for example, on the upper surface of which it is desired to place statuettes, ash trays and the like, cabinet modules as shown in FIGS. 5*a* and *b* are preferable.

Figure 5A:
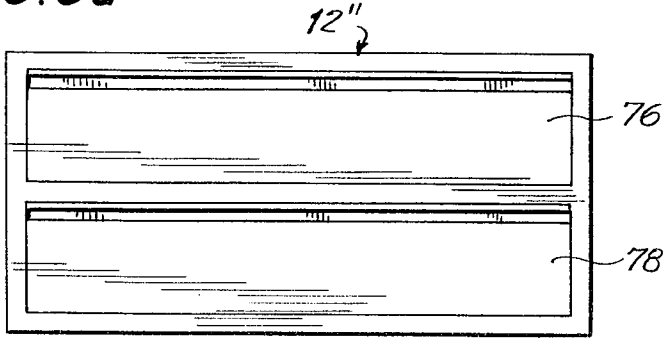
Figure 6A:
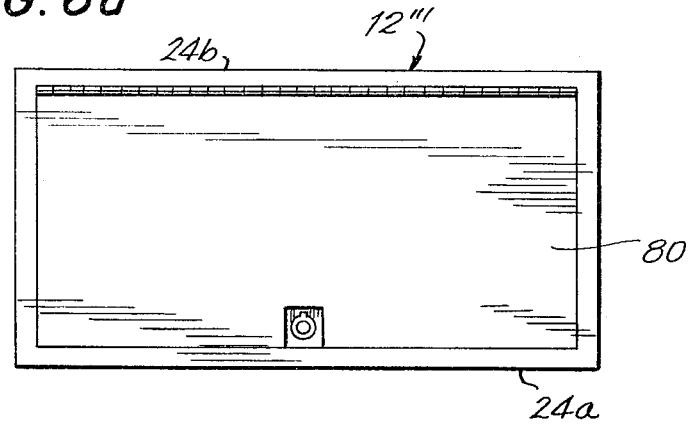

On the other hand, when for some reason it is not desired or feasible to provide space adjacent to the front or rear wall members to accommodate the opening of a drawer such as shown in FIGS. 5*a* and *b*, cabinet module 12‴ as illustrated in FIGS. 6*a* and *b* may be utilized. Thus, as seen in FIGS. 6*a* and *b*, the sole access to the interior storage space of cabinet module 12‴ is provided through the means of a lid 80 pivotally connected, such as by a piano hinge, to the top wall member of the cabinet module. Thus, for example, where the cabinet modules are interconnected to form an article of furniture which functions as a backrest in a seating area, i.e., where the rear wall member 24*b* is placed against a wall and the front wall member 24*a* serves as a backrest (being provided with a pillow or other type of appropriate finish), cabinet module 12‴ is particularly suitable.

Figure 8A:
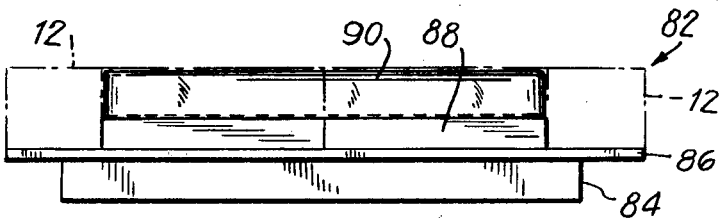
* and FIGS. 8*a* and 8*b* are front and plan views of yet another embodiment of an article of furniture constructed of cabinet modules according to the present invention.
Figure 8B:
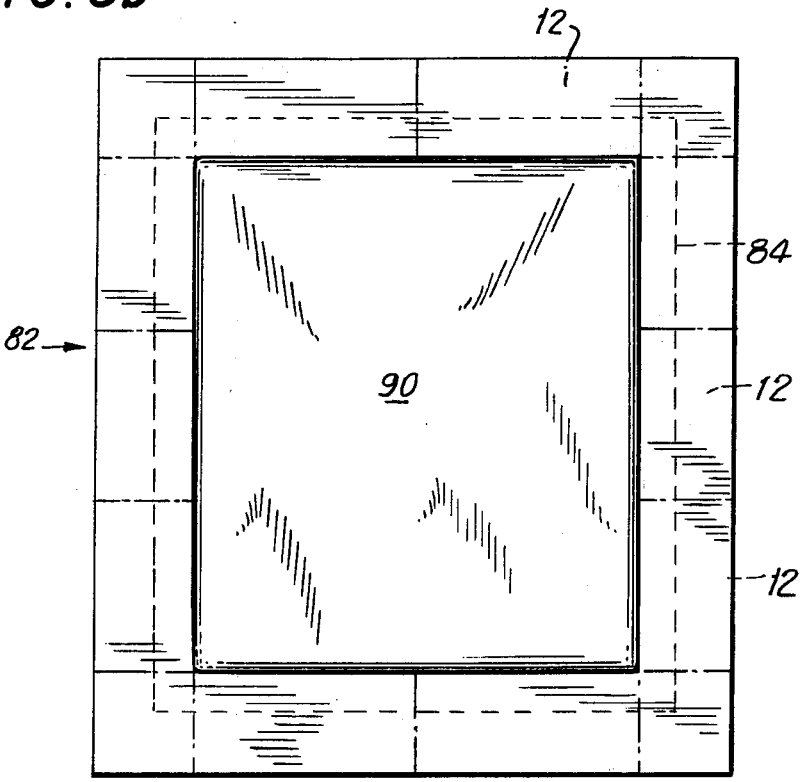

Turning now to FIGS. 8*a* and 8*b*, another embodiment of an article of furniture constructed of cabinet modules according to the present invention is illustrated. Like the article of furniture illustrated in FIG. 1, the article of furniture illustrated in FIGS. 8*a* and *b* comprises a bed structure 82, the cabinet modules defining the periphery of a rectangular, mattress-receiving space. More particularly, bed structure 82 comprises a lower rectangular space 84 preferably formed of four side walls interconnected at their end edges. A planar supporting member 86, preferably comprising a plywood sheet having a minimum thickness of one inch, is located over the base 84 in a manner such that its edge regions are cantilevered over the side walls defining base 84. In a preferred embodiment, base 84 is about six inches high and the cantilevered portion of the edge regions of the planar supporting member 86 extends beyond the side surfaces defining the base 84 by about ten inches.

A plurality of cabinet modules 12, schematically shown in the drawings, are located on the planar supporting member 86 so that their outwardly facing side wall members are flush with the edge of the planar supporting member as best seen in FIG. 8*a*. The depth of the cabinet modules 12 is such that the inner regions of the cabinet modules extend over the outer regions of base 84. As seen in FIG. 8*b*, the cabinet modules are interconnected in a manner similar to the structure illustrated in FIG. 1. However, the cabinet modules 12 utilized in connection with the article of furniture illustrated in FIG. 8 are preferably of a height of about twelve inches so that the total height of the bed structure 82 does not exceed twenty inches. Further, in addition to interconnecting the cabinet modules 12 to each other, each cabinet module is preferably fastened to the planar supporting member 86 in a manner which is apparent to one having skill in the art. Any appropriate filler material is located within the space 88 (FIG. 8*a*). A mattress 90 is received in the space defined by the cabinet modules.

The article of furniture illustrated in FIGS. 8*a* and *b* is extremely simple in construction and yet quite aesthetically pleasing. Bed structure constructed according to the present invention as illustrated in FIGS. 8*a* and *b* can be formed of any size and, similar to the bed structure illustrated in FIG. 1, can be formed using less than the four sides or modular subassemblies illustrated in the figures. The base 84 may be provided with incandescent lighting to accentuate the pleasing effect of the bed configuration.

Obviously, numerous modifications and variations of the present invention are possible in the light of the above teachings. It is therefore to be understood that within the scope of the claims, the invention may be practiced otherwise than as specifically disclosed herein.

What is claimed is:

1. An article of furniture, namely a bed, comprising:

a plurality of interconnected cabinet modules forming an assembly of modules, each of said cabinet modules being formed by exterior wall members defining an interior storage space therewithin and means for obtaining access to said interior storage space;

means for mutually interconnecting said modules to each other to form said assembly of modules; and said module assembly including four module sub-assemblies, each of said module sub-assemblies including at least two module sub-assemblies, each of said module sub-assemblies including at least two interconnected cabinet modules and wherein each of said module sub-assemblies is interconnected to another one of said module sub-assemblies which extends substantially perpendicularly thereto through a corner cabinet module, the latter including top, bottom, and four side surfaces, two of said side surfaces extending at right angles with respect to each other, said perpendicularly extending side surfaces being provided with means for interconnecting cabinet modules thereto, said module assembly thereby at least partially defining a frame assembly which itself defines the periphery of a substantially rectangular interior area adapted to receive a mattress therein whereby said module assembly alone or in combination with additional furniture components comprises said article of furniture.

2. An article of furniture as recited in claim 1 wherein the exterior wall members forming each of said cabinet modules includes front and rear wall members, left and right side wall members and top and bottom wall members, each of said modules having at least one of either a lid provided in said top wall member and a drawer provided in said front wall member communicating with said interior storage space, wherein said means for interconnecting said cabinet modules are associated with said side wall members in a manner such that upon interconnection of a pair of cabinet modules, the side wall members of respective modules are located in mutually contiguous relationship.

3. An article of furniture as recited in claim 2 wherein said means for interconnecting said modules comprises at least one elongate male fastener member passing through a connection area of one of said left and right side wall members and a cooperating female fastener member associated wih a connector area of the other of said left and right side wall members, such that when a pair of cabinet modules are located with their respective left and right side wall members being contiguous with each other, the corresponding connector areas are aligned with each other and said first and second fastener members in respective cabinet modules are aligned for interconnection with each other.

4. An article of furniture as recited in claim 3 wherein said first and second fastener members comprise elongate threaded members and an internally threaded member, respectively.

5. An article of furniture as recited in claim 3 wherein said first and second fastener members comprise snap fastener elements.

6. An article of furniture as recited in claim 2 wherein said means for interconnecting said modules comprises a first flange member fixed to the exterior of one of said left and right side wall members and a second flange member fixed to the exterior of the other of said left and right side wall members, such that when a pair of cabinet modules are located with their respective left and right side wall members being contiguous with each other, said first and second flange members of respective cabinet modules will interlock with each other.

7. An article of furniture as recited in claim 2 wherein said means for interconnecting said modules comprises vertically extending slots formed in respective left and right end regions of the front wall member of a cabinet module and an elongate connecting element having a pair of flange portion interconnected by a web portion, whereby upon locating a pair of cabinet member modules in adjacent contiguous relationship, said slots provided in respective left and right end regions of said respective cabinet modules are aligned for insertion of said flange portions of said elongate connecting element.

8. An article of furniture as recited in claim 1 wherein said bed further comprises a base member, a planar supporting member having peripheral edge regions which are cantilevered over the vertical edges of said base and wherein said module sub-assemblies are supported on the cantilevered peripheral edge regions of said planar supporting member.

9. An article of furniture comprising:

a plurality of interconnected cabinet modules forming an assembly of modules, each of said cabinet modules being formed by exterior wall members defining an interior storage space therewithin and means for obtaining access to said interior storage space;

means for mutually interconnecting said modules to each other to form said assembly of modules; and said module assembly including at least two module sub-assemblies, each of said module sub-assemblies including at least one cabinet module and wherein each of said module sub-assemblies is interconnected to another one of said module sub-assemblies which extends substantially perpendicularly thereto through a corner cabinet module, the latter including top, bottom, and four side surfaces, two of said side surfaces extending at right angles with respect to each other, said perpendicularly extending side surfaces being provided with means for interconnecting cabinet modules thereto, said module assembly thereby at least partially defining a frame assembly which itself defines the periphery of a substantially rectangular interior area adapted to receive a mattress therein.

* * * * *